US008999115B2

(12) United States Patent
Salonen

(10) Patent No.: US 8,999,115 B2
(45) Date of Patent: Apr. 7, 2015

(54) TEXTILE BELT, METHOD FOR MAKING IT, AND ITS USE

(71) Applicant: Valmet Fabrics, Inc., Tampere (FI)

(72) Inventor: Kari A. Salonen, Orivesi (FI)

(73) Assignee: Valmet Technologies, Inc., Espoo (FI)

( * ) Notice: Subject to any disclaimer, the term of this patent is extended or adjusted under 35 U.S.C. 154(b) by 0 days.

(21) Appl. No.: 14/370,130

(22) PCT Filed: Feb. 8, 2013

(86) PCT No.: PCT/FI2013/050138

§ 371 (c)(1),
(2) Date: Jul. 1, 2014

(87) PCT Pub. No.: WO2013/117817

PCT Pub. Date: Aug. 15, 2013

(65) Prior Publication Data

US 2014/0338853 A1 Nov. 20, 2014

(30) Foreign Application Priority Data

Feb. 10, 2012 (FI) ..... 20125145

(51) Int. Cl.

| | |
|---|---|
| ***D21F 1/10*** | (2006.01) |
| ***D21F 1/00*** | (2006.01) |
| ***D21G 1/00*** | (2006.01) |

(52) U.S. Cl.

CPC ..... *D21G 1/0066* (2013.01); *D21F 1/0027* (2013.01); *D21F 1/0054* (2013.01); *Y10T 29/49888* (2015.01)

(58) Field of Classification Search

USPC ..... 162/348, 358.2, 900–902, 256, 289, 162/109–117; 139/391, 383

See application file for complete search history.

(56) References Cited

U.S. PATENT DOCUMENTS

| | | | |
|---|---|---|---|
| 4,182,381 | A | 1/1980 | Gisbourne |
| 2004/0261884 | A1 | 12/2004 | Rydin |

FOREIGN PATENT DOCUMENTS

| | | | |
|---|---|---|---|
| GB | 1056351 | | 1/1967 |
| JP | A-2008-138315 | | 6/2008 |
| WO | WO 99/16965 | A1 | 4/1999 |
| WO | WO 00/12816 | A1 | 3/2000 |
| WO | WO 2004/029357 | A1 | 4/2004 |
| WO | WO 2006/053105 | A1 | 5/2006 |

OTHER PUBLICATIONS

International Search Report issued in International Application No. PCT/FI2013/050138 on Apr. 30, 2013.

Written Opinion of the International Searching Authority Report issued in International Application No. PCT/FI2013/050138 on Apr. 30, 2013.

International Preliminary Report on Patentability issued in International Application No. PCT/FI2013/050138 on Feb. 13, 2014.

*Primary Examiner* — Mark Halpern
(74) *Attorney, Agent, or Firm* — Oliff PLC

(57) ABSTRACT

An industrial textile belt, a method for making it, and its use. The belt includes a seam with joining ends that can be joined together so that the belt becomes an endless loop. The joining ends have seam areas with cross-machine direction wear yarns on their machine surface. The wear yarns receive wear stress when the belt slides against the support surface of a processing device.

10 Claims, 4 Drawing Sheets

TEXTILE BELT, METHOD FOR MAKING IT, AND ITS USE

This application is a 371 of PCT/FI2013/050138 filed 8 Feb. 2013.

BACKGROUND OF THE INVENTION

The invention relates to a textile belt for processing pulp or mass in a processing device. The belt is equipped with a seam so that it can be made into an endless loop in the processing device.

The invention further relates to the making and use of the belt. The field of the patent application is described in more detail in the preambles of the independent claims of the patent application.

Textile belts are used in industrial manufacturing processes for processing different fibre webs and fibre pulps, for example. Typically, processing refers to transporting the liquid-containing pulp on the product side of the belt and simultaneous draining of the liquid. The belt is run in an endless loop around the control and drive rolls. In addition, the belt is supported on its transport section against the structure of the processing machine so the belt rubs against the machine and wears on the machine-side surface. The belt may comprise a cross-direction seam, owing to which belt replacement is easier and faster than replacing a corresponding endless belt. However, the seam is the structurally weakest point of the belt. As the seam is also subjected to rubbing during use and wears, the belt often needs to be replaced due to the breaking of the seam or the weakening caused by wear. Belt replacement always brings about costs and downtime.

BRIEF DESCRIPTION OF THE INVENTION

An object of the present invention is to provide a novel and improved textile belt, a method for making it, and its use.

The belt of the invention is characterised in that the machine-side surface of the seam area has at least one cross-direction wear yarn that extends over the entire width of the belt in cross-direction and is arranged in the basic structure of the belt, but is functionally an extra wear-receiving yarn in respect of the basic structure of the belt.

The method of the invention is characterised in that, on the machine-side surface of the seam area, at least one cross-direction wear yarn is arranged to extend over the entire width of the belt in cross-direction, the wear yarn being arranged in the basic structure of the belt, but being functionally an extra wear-receiving yarn in respect of the basic structure of the belt.

The use according to the invention is characterised by running the belt as an endless loop in a planar washing device and feeding pulp on the product-side surface of the belt and transporting it on the suction table of the planar washing device so that liquid in the pulp filters through the belt.

The idea is to equip the seam area of the belt with at least one cross-direction wear yarn that protects the seam of the belt from wear. The cross-direction wear yarn is an extra yarn in respect of the functionality of the belt's basic structure and has no other purpose than to improve the wear resistance of the seam. Thus, the wear yarn is not intended to affect the density or marking of the seam area or other basic properties of the belt. The wear yarn extends in the entire width of the belt in the cross-machine direction CMD.

An advantage is that with the wear yarn, the seam can be separated from the surfaces on the machine side of the belt so that the wear of the seam can be avoided. In addition, the wear yarn increases the amount of material subjected to wear in the seam area, whereby less strain is applied to the critical parts of the seam in terms of durability even after the wear yarn has worn to the same level with the other yarns of the seam area. The wear yarns act as a sacrificing protection against wear in the belt. The wear and damaging of the wear yarns do not affect the functional properties of the belt at all, because the wear yarns are extra yarns without any other objectives than wear resistance.

Further, as the wear yarns are cross-directional to the belt, they do not stiffen the belt in machine direction. The belt then bends well even around drive and control rolls that have a relatively small diameter. Thus, wear protection does not weaken the runnability of the belt.

The idea of an embodiment is that the wear yarn has its own yarn system.

The idea of an embodiment is that both joining ends of the belt are equipped with a seam area that has a machine-direction length from the outermost edge of the joining end. Both seam areas are equipped with several cross-direction wear yarns on the machine-side surface of the belt. The seam area of the joining end may comprise 5 to 20 wear yarns. It is possible to affect the wear protection of the seam by varying the number, material, structure, dimension and weave of the wear yarns.

The idea of an embodiment is that the wear yarn extends further away from the outer surface of the belt than other yarns and joining members of the belt. The wear yarn may extend at least 0.2 mm further than other yarns belonging to the structure, whereby the other yarns of the seam area are protected against rubbing. When the wear yarn wears to the same level as the other yarns, it still continues to protect the seam, because it increases the volume of the material to be worn off in the seam area.

The idea of an embodiment is that the wear yarn is thicker than the other CMD yarns cross-directional to the belt.

The idea of an embodiment is that the wear yarn is of equal thickness as or thicker than the machine-direction MD yarns. The thickness of the wear yarn is typically one- to two-fold with respect to that of the machine-direction MD yarns.

The idea of an embodiment is that the thickness of the wear yarn is at least 1.5-fold with respect to that of the machine-direction MD yarns.

The idea of an embodiment is that the wear yarn is a flat yarn with a cross-section of an ellipse, rectangle or a rectangle rounded at its corners. A flat yarn has in its thickness direction more wearable volume than a yarn with a round cross-section, for example, that initially only forms a linear contact surface with the support surface. A flat yarn, in turn, has a large amount of wearable material on the contact surface so it loses thickness slower than a round yarn as a result of wear. Because with a flat yarn, a great deal of wearable volume is achieved on the surface of the belt, it is possible to use thinner yarns than when using round yarns.

The idea of an embodiment is that both joining ends of the belt are equipped with a seam area that has several cross-direction wear yarns. The machine-direction length of the seam area as seen from the outermost edge of the joining end is 20 mm or more. The machine-direction length of the seam area is typically 20 to 40 mm. A sufficiently long wear-protected portion provides the seam elements and seam a long service life.

The idea of an embodiment is that wear mass has been applied to the seam area of the belt to cover the yarns belonging to the basic structure of the belt at least on the machine surface. The wear mass can be made of epoxy. Further, the wear mass may be made of polyurethane or a corresponding polymer material having good wear resistance. The wear mass may be applied to the seam area by brushing, using a roll, spraying, casting, dipping or in some other suitable manner. The wear mass protects the seam and the yarns of the belt's basic structure in the seam area as well as the joining elements against wear. The seam area may be completely treated with the wear mass or alternatively the wear mass only covers limited areas of the seam area. The wear mass can also be applied as a strip in a pattern, a zig-zag, for example. The wear mass can be used together with wear yarns, or in some cases, the wear mass and wear yarns can be arranged in separate zones. The combination of wear mass and wear yarns has been found to provide a particularly good protection against wear. The wear mass may also help in supporting and fastening the wear yarns, which permits an even greater reach for the wear yarns from the basic structure on the machine surface. In practice, this means that it is possible to use wear yarns of great thickness. Further, it is possible to use long free floats in fastening the wear yarns, because the wear mass supports the yarn. Thus, with the wear mass, it is possible to increase the volume of the self-sacrificing material subjected to wear in a seam.

The idea of an embodiment is that in addition to the basic mass, the wear mass also comprises reinforcing material. The reinforcing material may be a fibre reinforcement, such as carbon fibre or glass fibre. Alternatively, the wear resistance of the wear mass can be improved by wear-resistant particles, such as metal particles. It is also possible to furnish the wear mass with nanoparticles.

The idea of an embodiment is that the cross-direction wear yarn is made of a material with good wear resistance.

The idea of an embodiment is that the cross-direction wear yarn is made of polyamide. Polyamide PA has good wear resistance. In addition, polyamide endures well alkaline conditions that occur in the washing of cellulose, for instance. The wear yarn is usually a monofilament yarn, but in some cases it may also be a multifilament yarn.

The idea of an embodiment is that the cross-direction wear yarn is made of polyetheretherketone PEEK. This type of yarn has good wear resistance and tolerance in acidic conditions.

The idea of an embodiment is that the cross-direction wear yarn is made of polyester PET that has good wear resistance and tolerance in acidic conditions.

The idea of an embodiment is that the cross-direction wear yarn is made of polyphenylsulphide PPS that has good wear resistance and tolerance in acidic conditions.

The idea of an embodiment is that the cross-direction wear yarn comprises carbon nanotubes. Thus, the material of the wear yarn may be, for instance, a polymer material reinforced with carbon nanotubes. Such wear yarns have a particularly good strength and their wear resistance may also be good. However, this type of wear yarn does not cause significant wear to the support surfaces of the processing device.

The idea of an embodiment is that the cross-direction wear yarn is made of metal. The wear yarn may be made of stainless steel or titanium, for instance. A metal wear yarn is well suited for use in the textile belts of slow-speed processing devices.

The idea of an embodiment is that the cross-direction wear yarn is arranged in the seam area by weaving. The wear yarn may be woven during the weaving of the basic structure of the textile belt, in which case the belt is woven in one weaving machine. Thus, the belt equipped with the wear yarn is then woven in one go in one weaving machine. Alternatively, the wear yarn may be fastened to the belt's basic structure during what is known as the re-weaving of the seam, wherein a seam area and a required number of wear yarns are woven into the pre-woven basic structure of the belt in a second weaving machine. One advantage of weaving is that the wear yarn fastens well into the belt's basic structure. Weaving is also relatively fast.

The idea of an embodiment is that the cross-direction wear yarn is arranged in the seam area by threading it in place in a step separate from weaving. The threading can be done manually. After threading the wear yarn binds to the machine-direction yarns of the basic structure.

The idea of an embodiment is that the wear yarn is fastened to the belt's basic structure by an adhesive agent, melting, welding, with mechanical fastening members, or a combination thereof. The fastening can yet be enhanced with wear mass.

The idea of an embodiment is that the wear yarn is pre-bent in its longitudinal direction so that its shape complies with the basic structure of the belt. The wear yarn then settles well into the basic structure and does not cause any changes in the positions of the yarns in the basic structure. Further, owing to this application, it is also possible to use wear yarns which have high bending resistance and the mounting of which in the belt without pre-bending would be difficult or even impossible.

The idea of an embodiment is that the cross-direction wear yarn has long free floats on the machine surface of the belt. Thanks to this feature, it is possible to increase the amount of wear yarn material on the machine surface of the belt, which further improves wear resistance. In addition, when this type of wear yarn finally wears through in use at the long free float, the thus freed yarn ends turn toward the opposite direction to the belt's direction of travel under the effect of the belt's movement and friction. Despite breaking, the wear yarns continue to protect the seam until the wear yarn has worn completely off the machine surface.

The idea of an embodiment is that the cross-direction wear yarn has a long free float on the machine surface of the belt over at least five machine-direction yarns.

The idea of an embodiment is that the cross-direction wear yarn has a long free float of 10 to 50 mm on the machine surface of the belt. Typically, the length of a free float is 30 to 40 mm.

The idea of an embodiment is that at least some of the machine-direction yarns of the belt form loops at the joining ends of the belt. Seam spirals can be connected to the opposite joining ends. This is called a spiral seam. The wear yarns protect the seam loops and the seam spiral at the joining ends. In the beginning of the use of the belt, the seam loops and seam spiral may be detached from the support surfaces of the processing device due to the wear protection.

The idea of an embodiment is that the joining ends of the belt have several seam loops formed by machine-direction yarns. The seam loops of opposite joining ends may be arranged to overlap so that they form a cross-directional seam loop channel. The joining ends can then be connected to each other by arranging a seam yarn or a corresponding connecting element into the seam loop channel. This is called a pin seam. The wear yarns protect the seam loops at the joining ends. In the beginning of the use of the belt, the seam loops may be detached from the support surfaces of the processing device due to the wear protection.

The idea of an embodiment is that the joining ends of the belt can be connected to each other with mechanical fastening elements that are separate elements from the belt structure. Fastening elements of this type may comprise hooks, barbs or corresponding projecting parts penetrating the belt structure, with which they fasten to the joining end. The fastening elements may be made of a synthetic material, such as a plastic material, or they may be of metal. This is called a clipper seam.

The idea of an embodiment is that the textile belt is a woven one-layer structure with cross-direction yarns in one layer. The cross-direction yarns criss-cross with the machine-direction yarns.

The idea of an embodiment is that the basic structure of the textile belt is other than a woven structure. The basic structure may be a wound structure or yarn assembly. The basic structure may be formed without the cross-direction yarns.

The idea of an embodiment is that the embodiments of a textile belt described in this patent application are used in a cellulose processing device for processing fibre material.

The idea of an embodiment is that the embodiments of a textile belt described in this patent application are used in a planar washing device intended for washing cellulose. The textile belt then serves as a filter belt, on the product side of which cellulose pulp is fed. The cellulose pulp is transported onward by means of the filter belt. On the machine side of the filter belt, there are suction boxes or corresponding suction devices that suck the liquid that has penetrated the filter belt. There are several consecutive suction zones, in general, 5 to 7. In the direction of travel, the filtrate of the last suction zone is fed to the pulp at the previous suction zone. The filtrates of the other suction zones are also fed to the pulp in the previous suction zone in the direction opposite to the belt's direction of travel. In a planar washing device of this type, it is possible to use the filter belts with seams described in this patent application.

The idea of an embodiment is that the embodiments of a textile belt described in this patent application are used in a band filter.

The idea of an embodiment is that the embodiments of a textile belt described in this patent application are used as paper machine belts in a paper or board machine. Paper machine belts include wet wires, drying wires, transport belts and other support belts on which a fibre web is processed.

The idea of an embodiment is that the embodiments of a textile belt described in this patent application are used in processing a fibre-like material, web or pulp.

The idea of an embodiment is that the embodiments of a textile belt described in this patent application are used in processing other than a fibre-like material. Thus, the pulp being processed may comprise minerals of the mining industry. Further, it is possible to process residual liquors and organic mass on the belt.

The idea of and embodiment is that the belt is run in a processing machine with its machine-direction edge sections bend away from the machine. The belt then also forms longitudinal sides that prevent the material being processed from leaking away from the belt in cross-direction. The bending of the belt edges can be facilitated by providing a discontinuation point, such as a flattening, in the wear yarns at the bending point, which then reduces the bending resistance of the edge section. Further, when the wear yarns are fastened by threading, separate shorter yarns can be used at the edges and separate longer yarns in the middle so that a bending point remains between the short and long yarns. When the seam area is additionally protected with wear mass, the mass can be applied as separate zones to the edges and mid-section, whereby discontinuation points form between the zones to facilitate the turning of the edges. It is also possible to make a discontinuation point in the mass by rolling a groove or the like to facilitate the bending.

BRIEF DESCRIPTION OF THE FIGURES

Some embodiments are explained in more detail in the accompanying drawings, in which.

For the sake of clarity, the figures show some embodiments in a simplified manner. In the figures, like reference numerals identify like elements.

DETAILED DESCRIPTION OF SOME EMBODIMENTS

Figure 1:
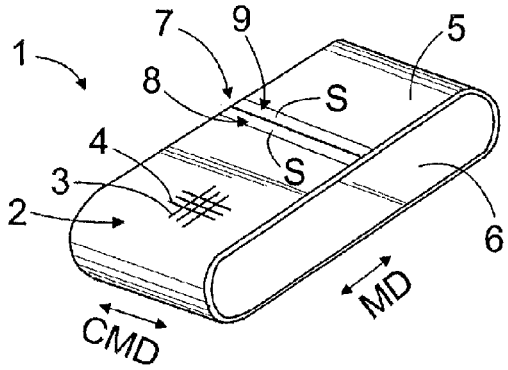
FIG. 1 is a schematic representation of a textile belt with a seam and the shape of a closed loop.

FIG. 1 shows a textile belt 1, the basic structure 2 of which may comprise yarns 3 in the machine direction MD and yarns 4 in the cross-machine direction CMD. The basic structure 2 may be woven, in which case the yarns 3 and 4 bind to each other according to the weave pattern. The belt 1 has a machine-direction MD length and cross-machine direction CMD width. Further, the belt 1 has a product surface 5, against which the pulp being processed is arranged, and a machine surface 6 which is the surface on the processing device side. The belt 1 comprises one or more seams 7 so it can be connected into an endless loop in the processing device, as shown in FIG. 1. For the seam 7, the belt 1 has a first joining end 8 and a second joining end 9 that are furnished with seam areas S that have a predefined length in the machine direction MD. The outermost edges of the joining ends 8 and 9 may be fastened to each other with connecting elements.

Figure 2B:
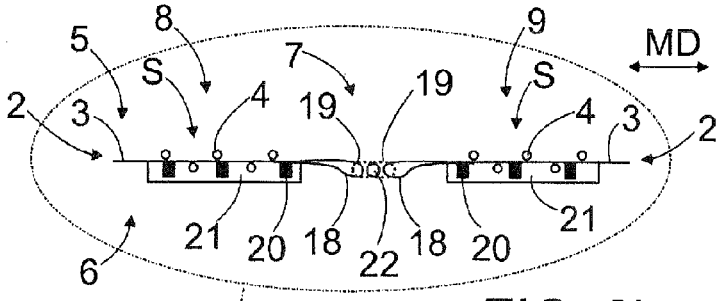
FIG. 2*b* is a schematic representation of a detail of the seam in a belt of a planar washing device.
Figure 2A:
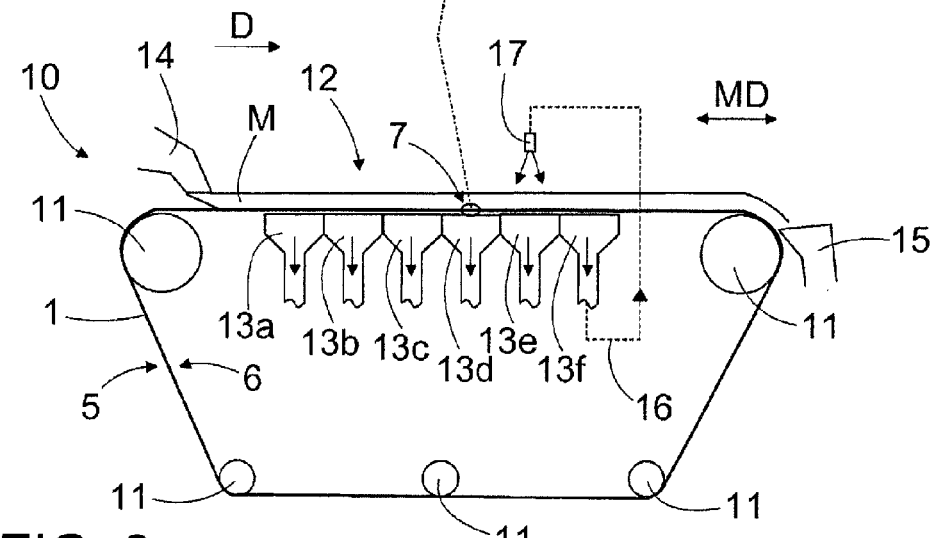
FIG. 2*a* is a schematic representation of a section of a planar washing device, in which pulp can be processed.

FIG. 2*a* shows a processing device, in which the belt 1 can be run. In this case, the processing device is a planar washing device 10. It should be noted that the device is shown in FIG. 2*a* as a highly simplified schematic figure.

The belt 1 is run in the planar washing device 10 as an endless loop around drive and control rolls 11. The device 10 has a suction table 12 that is divided into several suction zones, typically 5 to 8 zones. Each suction zone comprises a suction box or corresponding suction device 13*a* to 13*f* on the machine surface 6 side of the belt 1. The pulp M being processed is fed on to the suction table 12 from a supply channel 14, and after processing the pulp M exits from the device to a discharge channel 15 or discharge conveyor. The pulp M contains liquid that is filtered through the belt 1 under negative pressure. The liquid is recovered with suction devices 13. When the device 10 is examined in the direction of travel D of the belt 1, the liquid collected with the latter suction device in the direction of travel is fed back to the pulp M at the former suction device. This is illustrated in FIG. 1 by means of only one return channel 16 and spraying device 17.

The filtrate of the suction device 13*f* is thus fed to the pulp in the previous step 13*e*. A corresponding principle is repeated in the other suction zones.

The belt 1 comprises a seam 7, the principle of which is shown in the enlargement of FIG. 2*b*. The machine-direction MD yarns 3 belonging to the basic structure 2 of the belt 1 may form seam loops 18 at the joining ends 8, 9. All yarns 3 or some of the yarns 3 may participate in forming the seam loops 18. Seam spirals 19 that can be connected to each other with a seam yarn 22 can be connected to the seam loops 18. During use, the machine surface 6 of the belt 1 rubs against the suction table 12 and wears. The seam 7 is typically the weakest point of the belt 1 in terms of machine-direction strength. To improve the wear resistance of the seam 7, both seam areas S may be furnished with one or more cross-machine direction CMD wear yarns 20 on the machine-side 6 surface. Generally, several, for instance 5 to 10, wear yarns are arranged in the seam area S, but in some cases, even a smaller number of wear yarns may suffice. Wear yarns 20 are typically arranged in both seam areas S, but sometimes it may suffice to protect only one of the seam areas of the seam 7 against wear. The wear yarns 20 may extend from edge to edge in the cross-machine direction CMD of the belt 1. The wear resistance of the seam area may be improved with both the wear yarn 20 and by treating the seam area S with wear mass 21. Wear mass 21 is a mass with good wear resistance and which fastens tightly to the belt 1. The wear mass 21 may be a glue-like mass that partly penetrates into the basic structure 2 of the belt 1. The wear yarns 20 and wear mass 21 extend on the machine surface 6 further than the basic structure 2 and seam elements, whereby they receive the wear stress directed to the machine surface 6. Only after the wear yarns 20 and wear mass 21 have worn to the same level with the basic structure 2 may wear stress be directed to the seam 7.

As seen in FIG. 2*b*, the wear mass 21 may also cover the wear yarns 21 on the machine surface 6. The wear is then only directed to the wear mass 21 in the first phase. In the second phase, the wear yarns 20 and wear mass 21 are together subjected to wear.

Figure 3:
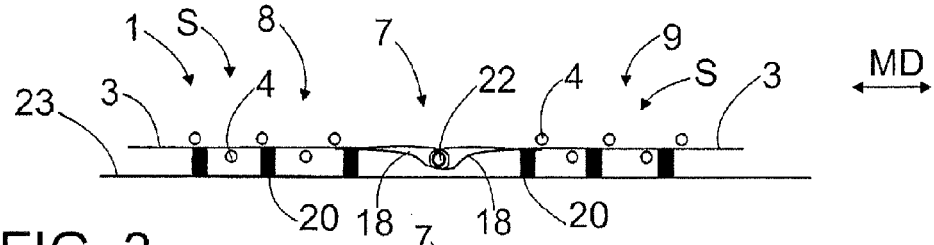
FIGS. 3 and 4 are schematic representations of the seams of some belts and the protection of the seams against wear.

FIG. 3 shows another embodiment of the seam 7 of the belt 1. The seam 7 comprises seam loops 18 formed by the machine-direction MD yarns at both joining ends 8 and 9. The seam loops 18 of opposite joining ends 8 and 9 are arranged to overlap so that they form a cross-machine direction CMD seam loop channel, to which an elongated connecting element, typically a seam yarn 22, is arranged to fasten the joining ends 8 and 9 to each other.

FIG. 3 illustrates the fact that sufficient wear protection can also be obtained with the wear yarns 20 without the wear mass 21. The wear yarns 20 then receive the wear stress in the first phase, when the belt 1 slides along the support surface 23 of the processing device. The support surface 23 may be the above-mentioned top surface of the suction table or some other support or guide surface.

Figure 4:
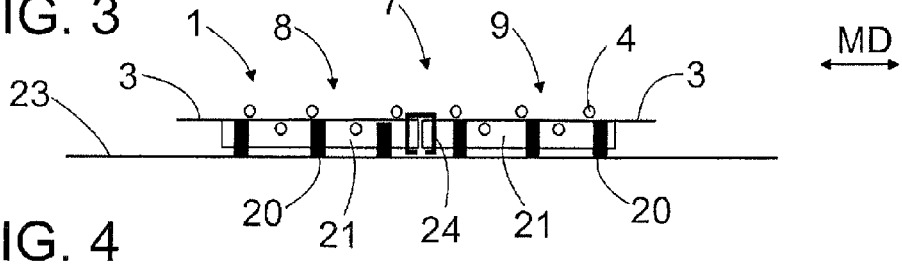

FIG. 4 shows yet another alternative solution to joining the joining ends 8 and 9 of the belt 1 to each other. In this embodiment, one or more separate mechanical pieces 24 that penetrate the structure of the belt 1 and fasten the joining ends to each other can be used as the connecting element. The connecting element may be a 'clipper'.

FIG. 4 illustrates the fact that the wear yarns 20 may also be arranged to extend further on the machine surface 6 than the wear mass 21. A wear effect is then directed to the wear yarns 20 in the first phase, when the belt 1 slides along the support surface 23 of the processing device.

Figure 5A:
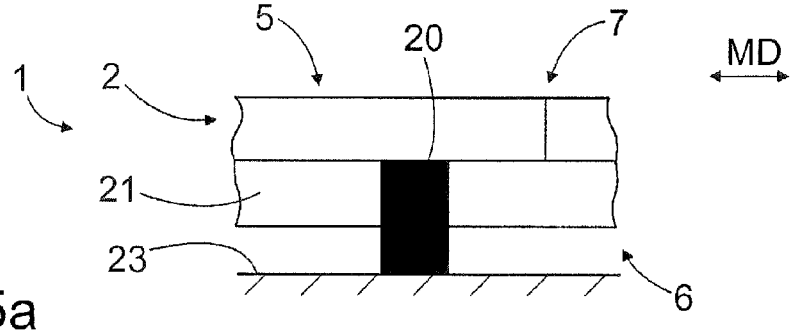
FIGS. 5*a* to 5*c* are schematic representations of the wear of components related to the protection of a seam during the use of a belt.
Figure 5B:
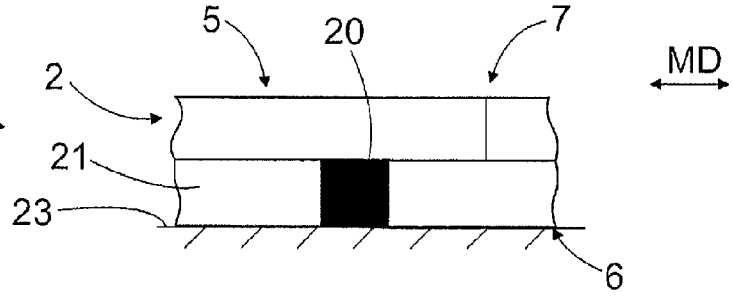
Figure 5C:
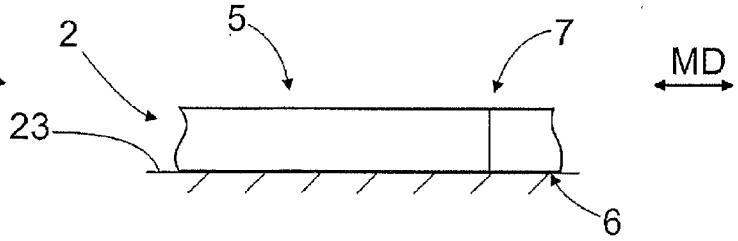

FIGS. 5*a* to 5*c* illustrate the wear of the belt 1 on the machine surface 6 in phases. In FIG. 5*a*, the wear yarn 20 is against the support surface 23 and the wear stress is directed essentially only to the wear yarn 20. In FIG. 5*b*, the wear yarn 20 has worn to the same level with the wear mass 21, in which case the wear stress is, in this second phase, directed to the wear yarn 20 and wear mass 21. FIG. 5*c* shows a situation, in which the wear protection has entirely worn off. Only in this third phase does the wear effect act on the basic structure 2 of the belt. With this type of wear protection, it is thus possible to lengthen significantly the service time of the belt 1.

Figure 6:
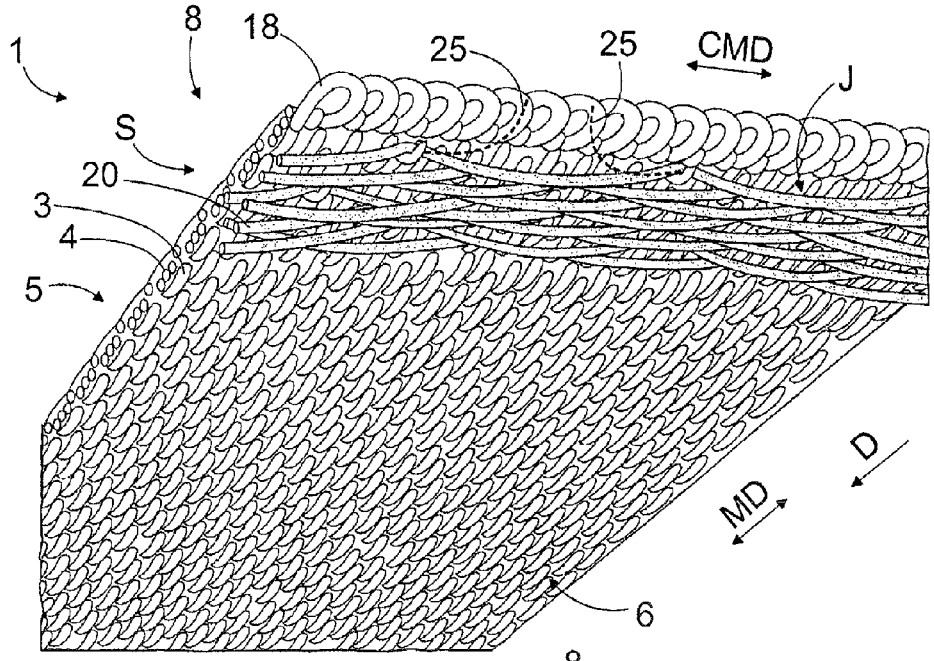
FIG. 6 is a schematic representation as seen from the machine side of a joining end of a belt, in which the seam area is furnished with several wear yarns.

FIG. 6 shows the seam area S of a belt 1 and the binding of the wear yarns 20 with the machine-direction yarns 3 of the basic structure 2. In the embodiment of FIG. 6, there are seven wear yarns 20 in the seam area S, and they have long free floats J. A dashed line in FIG. 6 shows a situation, in which the wear yarn 20 has broken due to wear at the long float J, after which the ends 25 of the yarn have turned in a direction opposite to the direction of travel D. The ends 25 of the wear yarn 20 then provide wear protection to the seam loops 18 even after breaking.

Figure 7:
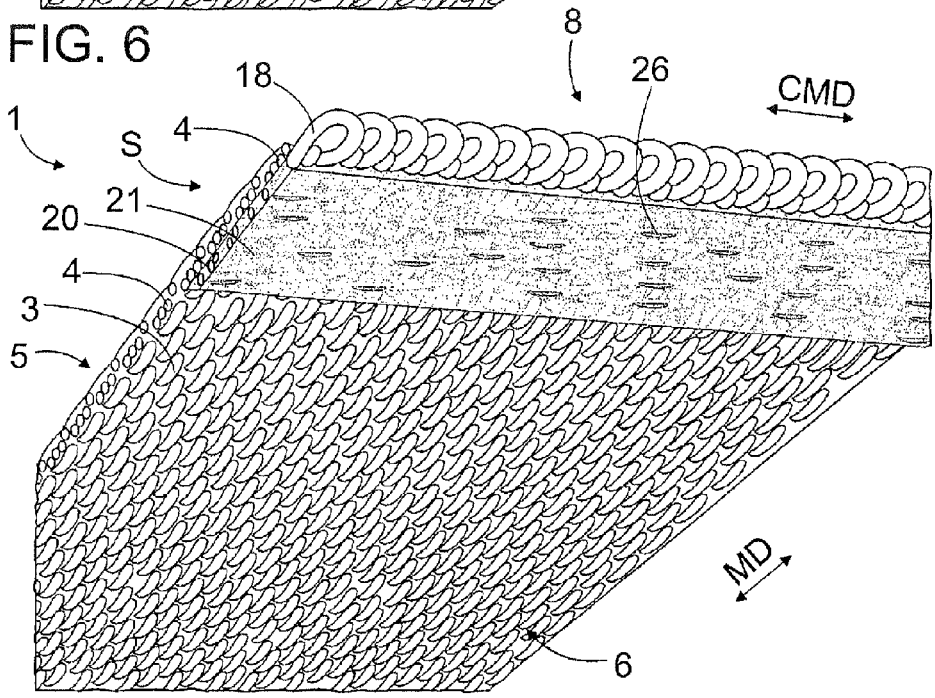
FIG. 7 is a schematic representation as seen from the machine side of joining end of a second belt, in which the seam area comprises wear yarns and wear mass.

FIG. 7 shows an alternative embodiment to the seam area S shown in FIG. 6. The seam area S has been treated with wear mass 21. The wear yarns 20 may partly extend to the surface of the machine side 6, as illustrated by arrow 26.

Figure 8:
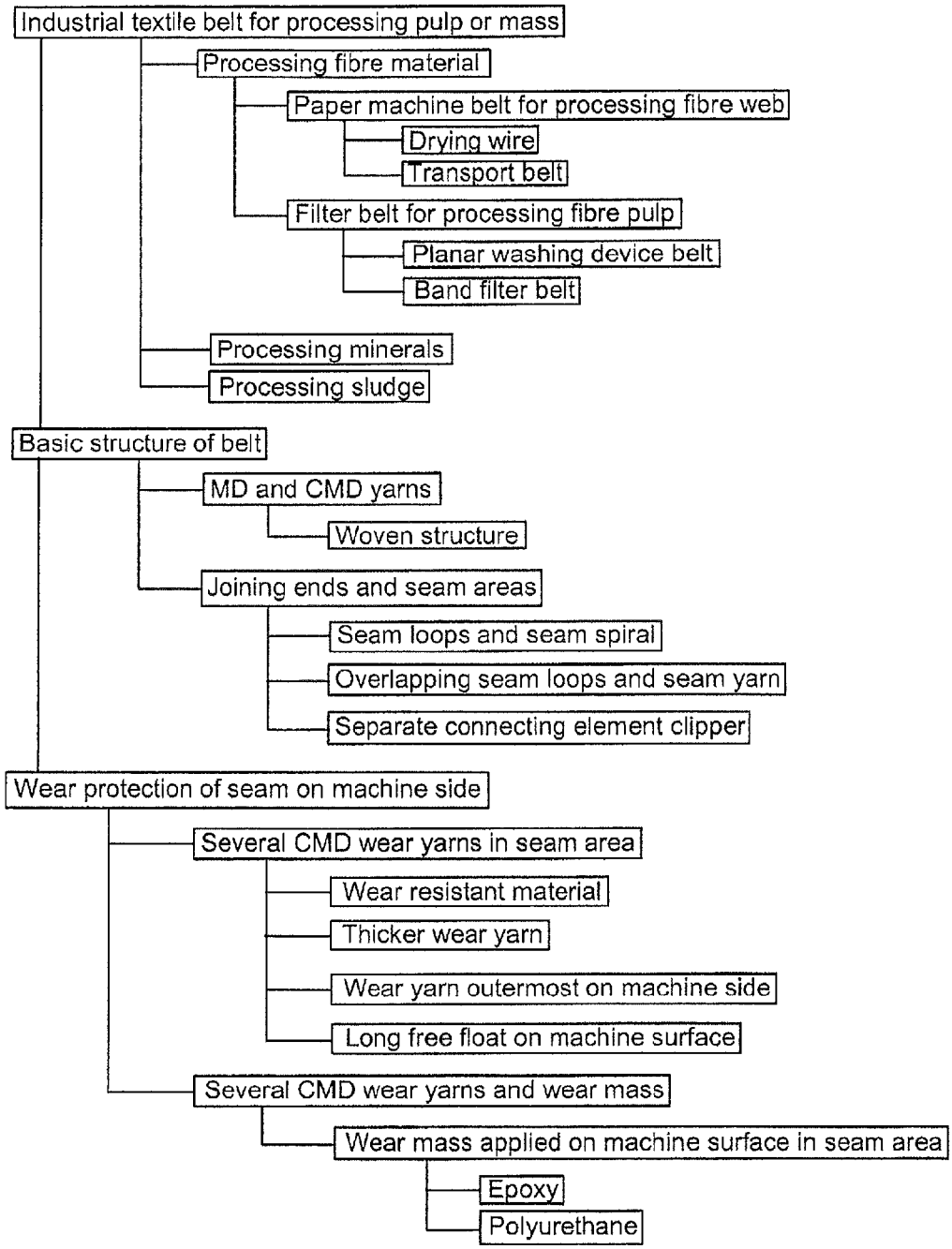
FIG. 8 is a diagram of the features discussed in this patent application.

FIG. 8 is a simplified diagram showing matters related to the use and structure of the belt as well as alternative embodiments. The features shown in FIG. 8 have already been discussed earlier in this patent application.

In some cases, features disclosed in this application may be used as such, regardless of other features. On the other hand, when necessary, features disclosed in this application may be combined in order to provide various combinations.

The drawings and the relating description are only intended to illustrate the idea of the invention. Details of the invention may vary within the scope of the claims.

The invention claimed is:

1. An industrial textile belt for the processing of pulp or mass, the belt having a machine-direction width and a cross-machine direction length as well as a machine surface on the processing device side and a product surface on the processed mass side;

and the belt comprises:

several machine-direction yarns;

a first joining end and a second joining end, the joining ends comprising seam areas with a machine-direction length;

connecting elements at the outermost ends of the seam areas, whereby the joining ends of the belt are joinable to each other to form an endless structure;

and wherein the machine surface of the seam area has at least one cross-machine direction wear yarn that covers the entire width of the belt in cross-machine direction and that is arranged into the basic structure of the belt but is functionally an extra wear-receiving yarn in respect of the basic structure of the belt;

and the machine surface of the seam area has wear mass that covers at least part of the yarns of the seam area.

2. A belt as claimed in claim 1, wherein the wear yarn extends further from the belt's machine surface that the other yarns and connecting elements of the belt, whereby the wear yarn serves as a self-sacrificing wear protection.

3. A belt as claimed in claim 1, wherein the thickness of the wear yarn is at least equal to that of the machine-direction yarns.

4. A belt as claimed in claim 1, wherein the thickness of the wear yarn is at least 1.5-fold to that of the machine-direction yarns.

5. A belt as claimed in claim 1, wherein the wear yarn has long free floats on the machine surface over at least five machine-direction yarns.

6. A belt as claimed in claim 1, wherein the machine surface of the seam area has wear mass that covers all yarns in the seam area including the wear yarns, whereby the wear mass forms the outermost surface of the seam area on the machine surface.

7. A belt as claimed in claim 1, wherein the belt has a woven basic structure that comprises several machine-direction yarns and several cross-machine direction yarns that bind to each other.

8. A method of manufacturing an industrial textile belt, the method comprising:

forming a belt having a machine-direction length and a cross-machine direction width as well as a machine surface on the processing device side and a product surface on the processed mass side;

weaving the basic structure of the belt from several machine-direction yarns and several cross-machine direction yarns;

forming on the belt a first joining end and a second joining end as well as seam areas on both joining ends;

arranging at the joining ends connecting elements for joining the belt into an endless loop;

arranging on the machine surface of the seam area at least one cross-machine direction wear yarn to extend over the entire cross-machine direction width of the belt, the wear yarn being arranged into the basic structure of the belt but being functionally an extra wear-receiving yarn in respect of the basic structure of the belt;

and applying wear mass to the seam area for covering at least part of the yarns of the seam area.

9. A method as claimed in claim 8, comprising fastening several wear yarns in the seam area by weaving.

10. A method for the processing of pulp or mass with the industrial textile belt as claimed in claim 1, comprising:

running the belt in an endless loop in a planar washing device;

and feeding mass on the product surface of the belt and transporting it on the suction table of the planar washing device, whereby liquid contained in the mass is filtered through the belt.

* * * * *